United States Patent [19]

Bulso, Jr. et al.

[11] Patent Number: 4,696,177

[45] Date of Patent: Sep. 29, 1987

[54] METHOD AND APPARATUS FOR FORMING CONTAINERS

[75] Inventors: Joseph D. Bulso, Jr., Canton; James A. McClung, North Canton, both of Ohio

[73] Assignee: Redicon Corporation, Canton, Ohio

[21] Appl. No.: 49

[22] Filed: Dec. 31, 1986

[51] Int. Cl.[4] ..... B21D 22/00

[52] U.S. Cl. ..... 72/379; 72/329; 72/349; 72/405; 72/426; 72/351; 413/69

[58] Field of Search ..... 72/347, 348, 349, 377, 72/379, 427, 405, 329, 330, 336, 350, 351, 352, 426; 413/69

[56] References Cited

U.S. PATENT DOCUMENTS

| | | | |
|---|---|---|---|
| 2,183,287 | 12/1939 | Candee | 113/38 |
| 3,512,391 | 5/1970 | Bozich | 72/361 |
| 3,628,368 | 12/1971 | Cvacho et al. | 72/361 |
| 3,715,905 | 2/1973 | Paramonoff | 72/349 |
| 3,786,667 | 1/1974 | Garnett | 72/351 |
| 3,800,583 | 4/1974 | Miller | 72/349 |
| 3,902,347 | 9/1975 | Ridgway et al. | 72/336 |
| 4,007,621 | 2/1977 | Franek et al. | 72/347 |
| 4,020,670 | 5/1977 | Bulso, Jr. et al. | 72/349 |
| 4,051,707 | 10/1977 | Valek et al. | 72/348 |
| 4,061,012 | 12/1977 | Wessman | 72/347 |
| 4,193,285 | 3/1980 | Zumsteg | 72/348 |
| 4,203,314 | 5/1980 | Vandlik et al. | 72/427 |
| 4,214,471 | 7/1980 | Bulso, Jr. et al. | 72/349 |
| 4,248,076 | 2/1981 | Bulso, Jr. et al. | 72/349 |
| 4,364,255 | 12/1982 | Byrd | 72/345 |
| 4,386,514 | 6/1983 | Herten | 72/347 |
| 4,414,836 | 11/1983 | Saunders | 72/348 |
| 4,584,859 | 4/1986 | Saunders | 72/349 |

*Primary Examiner*—Robert L. Spruill
*Assistant Examiner*—Donald R. Studebaker
*Attorney, Agent, or Firm*—Reese Taylor

[57] ABSTRACT

A method of forming a container in one or more double acting presses includes the steps of blanking, drawing an inverted cup and reverse drawing the inverted cup while retaining a flange thereon at a first station and then transferring the cup to a second station where the cup is drawn to an inverted configuration and then reverse drawn to form a finished container again retaining the flange throughout. The drawing operations at each station are performed in a single stroke of the press. The apparatus at the first station includes a blank and draw punch and a fixed, hollow die core ring with the punch telescoping over the ring to form the inverted cup and a draw horn telescoping within the ring to reverse draw the cup. The apparatus at the second station includes a hollow redraw sleeve and a pressure sleeve telescoping over the redraw sleeve to invert the cup and a profile punch telescoping within the redraw sleeve to reverse draw the cup.

16 Claims, 14 Drawing Figures

METHOD AND APPARATUS FOR FORMING CONTAINERS

FIELD OF THE INVENTION

This invention relates, in general, to the production of two-piece containers from sheet or coil stock and relates, in particular, to the production of such containers, of both coated and uncoated steel and aluminum and other materials, without any mechanical transfer, at high speeds, while maintaining a flange at all times and avoiding the pinching problems normally encountered.

DESCRIPTION OF THE PRIOR ART

It is well-known in the container forming art to form two-piece containers, that is containers in which the walls and the bottom are of one piece and the top or end closure is of a separate piece, by means of drawing and redrawing metal and other materials. In broad terms, the prior art discloses starting with flat material either in sheet or coil form, blanking material from that stock and then drawing it into a cup and further redrawing it into a flanged container.

There are a number of prior art patents illustrating various approaches to this problem. Examples can be seen in Candee U.S. Pat. No. 2,183,287; Bulso U.S. Pat. No. 4,020,670; Bulso U.S. Pat. No. 4,214,471; and Bulso U.S. Pat. No. 4,248,076. Generally, these approaches involve forming the cup in one station and then transferring the cup to a second station where it is drawn or redrawn into the finished container. Essentially, these patents disclose in line draw and redraw systems wherein the flanges are pulled off during the draw and redraw steps.

This methodology, generally, also necessitates, of course, some sort of transfer mechanism, as can be seen in Bozich U.S. Pat. No. 3,512,391; Cvacho U.S. Pat. No. 3,628,368; Parmonoff U.S. Pat. No. 3,715,905; Miller U.S. Pat. No. 3,800,583; Wessman U.S. Pat. No. 4,061,012; Vandlik U.S. Pat. No. 4,203,314; and Byrd 4,364,255.

All of these approaches are, presumably, satisfactory for the purposes for which they are designed.

However, they all have various deficiencies when certain desirable characteristics of the finished product are considered.

Specifically, it is believed desirable to produce an apparatus and method which is capable of producing finished containers from either steel or aluminum or other materials and from either coated or uncoated stock.

It is also desirable to control the sidewall thickness on coated stock without damage to the coating and to produce the containers from as light a guage of material as possible for obvious economic reasons. One problem with the in line approach is that, since the metal is flowing in the direction of the draw, fairly high holding pressure is required which can result in pinching of the flange and damage to the coating and material fiber by feathering the flange edge.

It is also believed desirable to increase the speed of operation of such a system and to eliminate mechanical transfers, wherever possible, since these transfers limit the speed with which the press can be operated. Elimination of such transfers also enables lighter reductions to be taken without loss of speed and with a more uniform flange with less earring.

It is therefore believed desirable to form containers in this general fashion having flanges on them and without removing the flange throughout the drawing and redrawing operation, but without pinching it either wherein the precoated material, in particular, avoids damage.

Finally, it is believed to be desirable to minimize handling of the workpiece to minimize damage and this can be advantageously accomplished by reverse drawing to avoid inserting the tooling only once.

In general, then, it is believed desirable to produce such a system which is operable in either one or two presses which has universal application and can be used, as previously noted, with all different types of material and with coated and uncoated material, thereby providing a very versatile, efficient and ecomonical system.

SUMMARY OF THE INVENTION

It has been found that such a system can be provided by a method of forming a container in a double-acting press can be attained wherein, at a first station, the material is blanked, drawn to an inverted cup shape and then reverse drawn to form a flanged cup.

At a second station, the flanged cup can then be drawn into a second inverted cup and reverse redrawn into a flanged container. Optionally, the bottom can also be profiled at this time.

This triple reverse draw permits the metal to be worked easier, thereby minimizing damage, particularly to coated material. It also minimizes damage such as denting by making it possible to introduce the tooling to the workpiece only once.

This system is utilizable in either a single or double press system and eliminates the need for mechanical transfer means, thereby making it possible to operate at much higher speeds and also to avoid alignment problems and damage to the containers during the usual mechanical transfer operations.

Accordingly, it becomes the principal object of this invention to produce a method and apparatus of the character above-described with further objects, thereof, becoming more apparent upon a reading of the following brief specification considered and interpreted in view of the accompanying drawings.

OF THE DRAWINGS

BRIEF DESCRIPTION OF THE PREFERRED EMBODIMENTS

Figure 1:
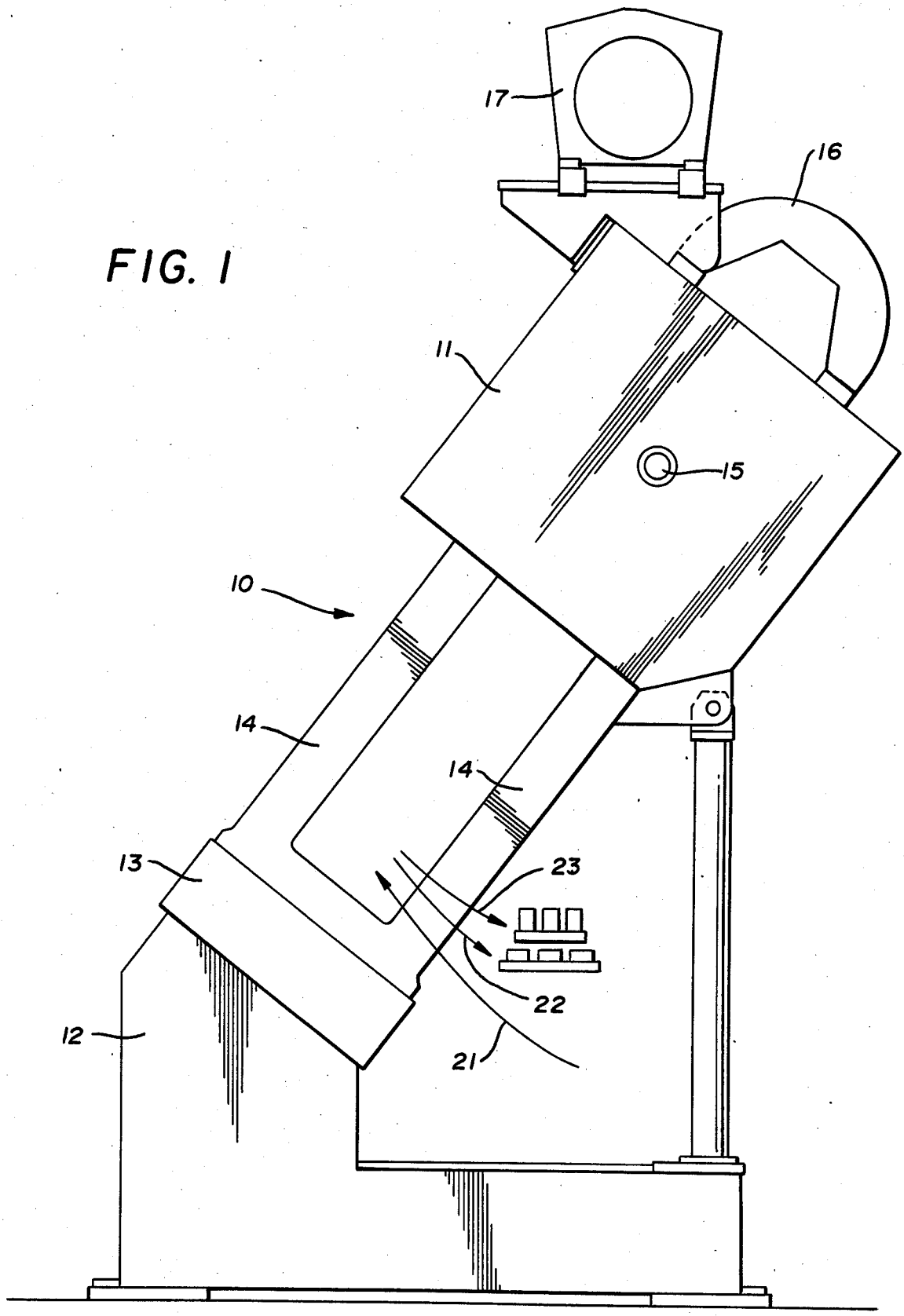
FIG. 1 is a partially schematic elevational view of the press embodying the system.

Referring, first, to FIG. 1 for a general view of the press, it will be understood that the invention is, primarily, intended for use with double acting presses having inner and outer slides reciprocal with regard to a press base and capable of independent control and timing. An example of such a press can be seen in Ridgway U.S. Pat. No. 3,902,347 and the press will be described herein only in general terms, since the design and operation of such double acting presses is well-known in the art.

Accordingly, and still referring to FIG. 1 of the drawings, it will be seen that the press, generally indicated by the numeral 10, includes a head or crown 11, a base 12 and a press bed 13. The bed 13 and head 11 are interconnected by uprights 14,14 which provide guide means for travel of the inner and outer slides which are not illustrated in FIG. 1. While members 14,14 are commonly referred to as "uprights", it will be noted that here the entire press is installed at an angle to the perpendicular and the press may be referred to as an inclined press. This press disposition facilitates the elimination of conventional transfer mechanisms as will be described below.

The inner and outer slides of the press 10 carry the draw and redraw tooling and are driven by a crankshaft 15 which is, in turn, driven by a fly wheel 16 which is, in turn, driven by a motor 17.

As previously noted, it will be understood that a press of this type is capable of moving the inner and outer slides toward and away from the bed 13 and that the movement of these slides can be controlled and adjusted independently of each other as clearly disclosed, for example, in Ridgway U.S. Pat. No. 3,902,347 already referred to. In this fashion, the tooling carried on these slides can, likewise, be independently controlled.

Figure 2:
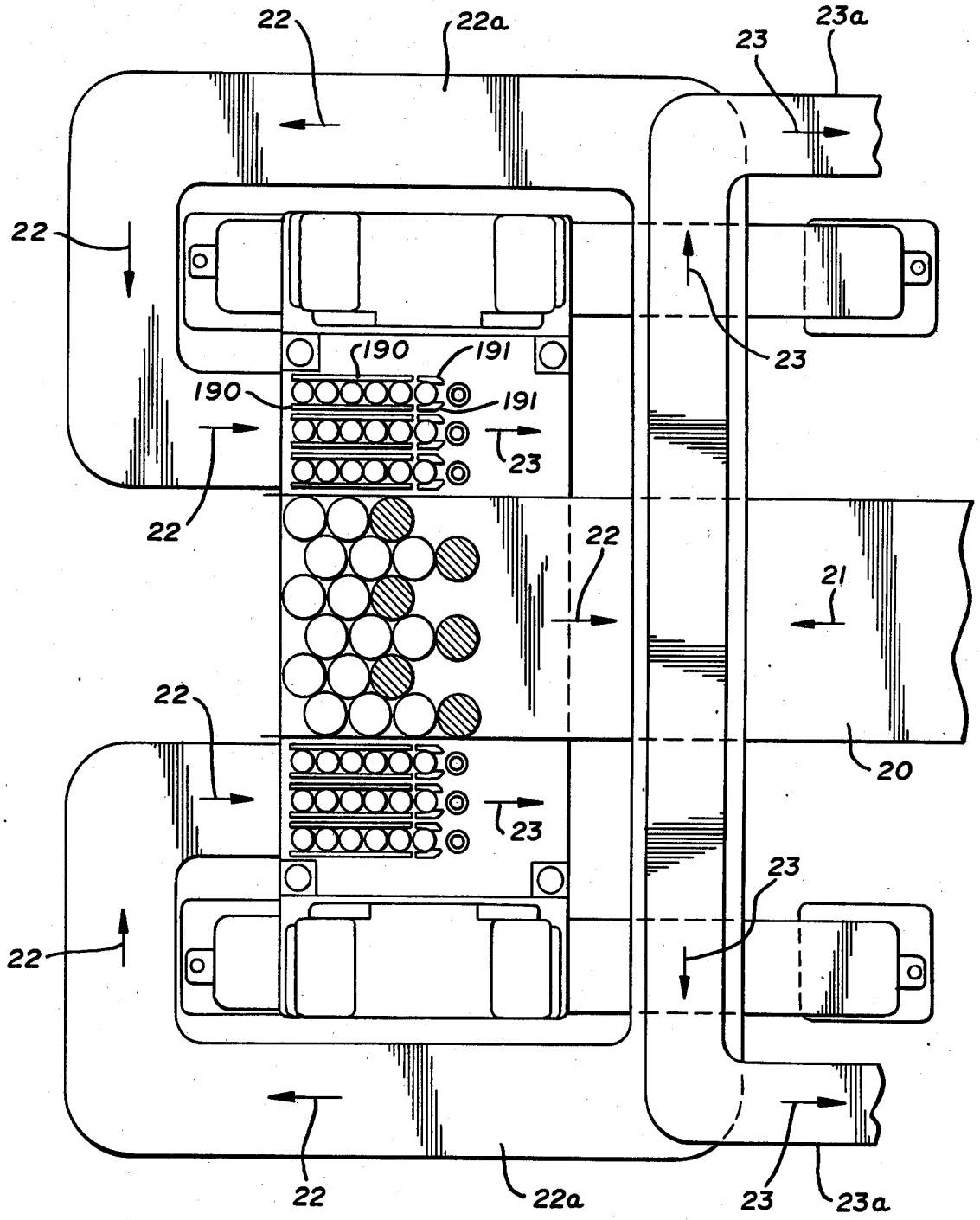
FIG. 2 is a partially schematic plan view of the operational area of the press.

FIG. 2 of the drawings illustrates a plan view of the tooling layout within the operational area of the press and its associated conveyors and provides for a stock feed, generally indicated by the numeral 20, in the direction of the arrow 21. This stock can be fed either from a coil or from sheets, as is well-known in the art.

As noted, the stock 20 enters the press in the direction of the arrow 21 and the tooling of a first station performs the blanking and cup forming operation. The cups then leave the press in the direction of the arrow 22 onto conveyors 22*a* which are disposed above the stock feed and then reenter the press at a second station, again, in the direction of the arrows 22.

The finished containers, then, exit the press in the direction of the arrows 23 onto suitable conveyors 23*a* which are disposed above conveyors 22*a* for discharge, again, in the direction of the arrows 23.

More specific detail of most of this structure will described below, but FIG. 2 generally shows the path of movement from the stock 20 entering the press to the finished container CFC leaving the press from the second station. The conveyor system is shown and described in general terms only, since, other than its specific layout with respect to the press, its function and structure is essentially conventional.

Turning, then, to FIGS. 3 through 8, it will be noted that this is a series of partial elevational views, partially in section, showing the position of the tooling of the first station in various positions as the various operations are performed on material 20 by that tooling. It will also be noted that the direction of material flow will be identified by arrows 100 in these views.

Figure 3:
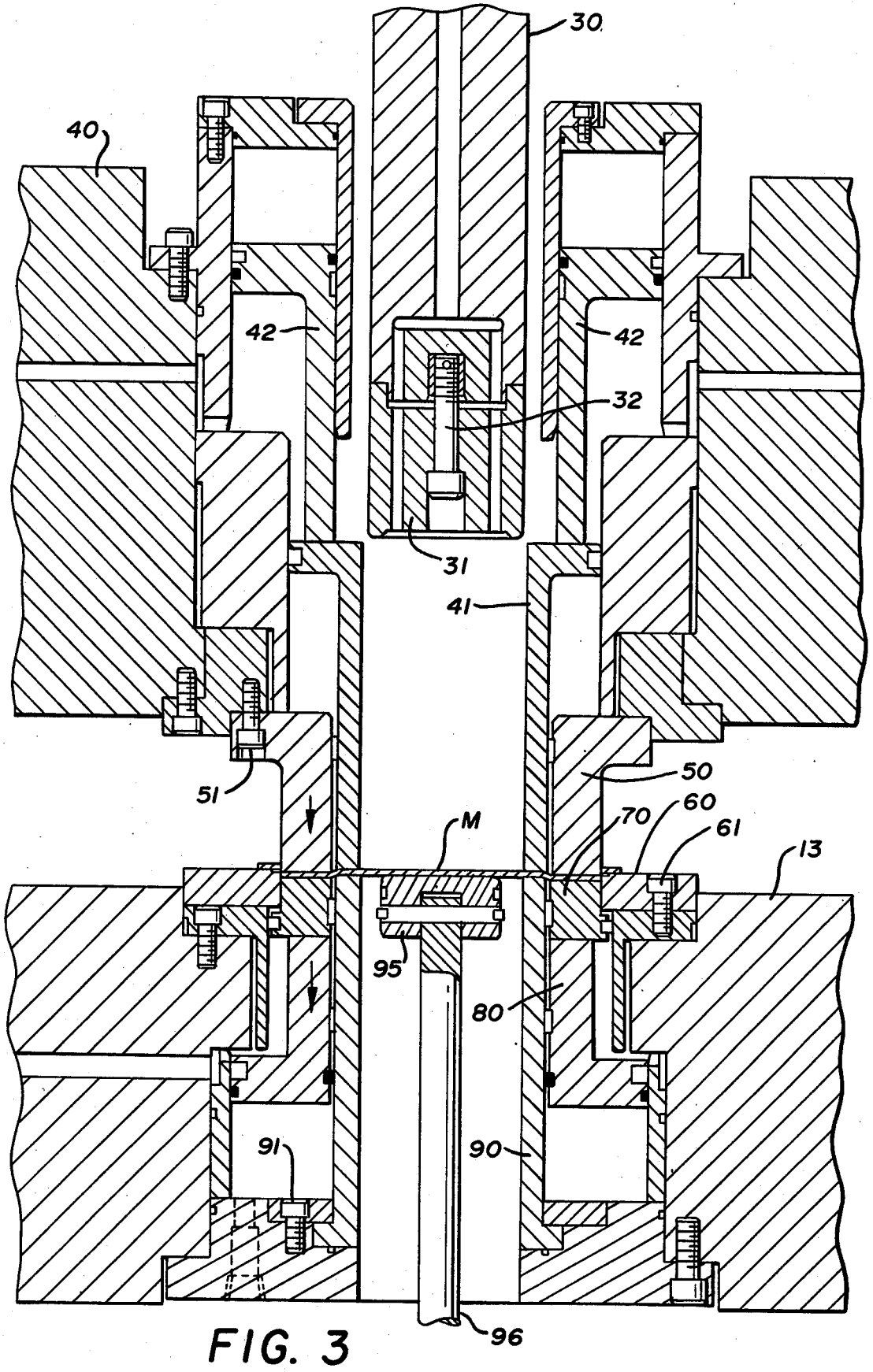
FIG. 3 is a partial elevational view, partially in section, showing the blanking operation at the first station.

Referring first, then, to FIG. 3, it will be noted that the inner slide of the press carriers a draw horn riser 30 and a draw horn 31 secured thereto in adjustable fashion by a screw 32. Thus, the draw horn 31 is capable of movement in reciprocal fashion with respect to the base 12 and bed 13 of the press upon movement of the inner slide toward and away from that base.

Carried on the outer slide of the press is an outer slide holder 40 which is also reciprocal with respect to bed 13 upon movement of the outer slide. This slide holder 40 carries an upper pressure sleeve 41 and an upper piston 42. The piston 42 is designed to operate hydraulically or pneumatically on the pressure sleeve 41, as will be described in greater detail below.

Also carried on the outer slide holder 40 is a blank and draw punch 50 which is secured in place by suitable screws 51 and is disposed concentrically outboard of pressure sleeve 41.

The bed 13 of the press, in the first station, contains a cut edge 60 secured thereto by one or more screws 61 and a draw pad 70, inboard of the cut edge 60 and which is reciprocal with respect to the base 12 and bed 13.

In that regard, a lower piston 80 is provided beneath the draw pad 70 and is actuated fluidly so as to reciprocate within the bed 13.

Further inboard of the draw pad 70 and the lower piston 80 is a die core ring 90 which is fixed to the bed 13 by one or more screws 91, as can be seen clearly in FIG. 3.

A knockout pad 95 is also carried by the base 12 and is reciprocal with respect to the base by means of the rod 96. Knockout pad 95 can be actuated pneumatically, hydraulically or mechanically as desired.

It should be noted that FIG. 3 and the ensuing drawings illustrate one set of tooling. From FIG. 2, it will be apparent that, normally, multiple sets would be provided so that a plurality of cups may be formed on each stroke of the press.

In FIG. 3, the tooling is illustrated in the starting position in that the stock 20 has been fed into the first station of the press in the direction of the arrow 21 of FIG. 2. At this point, the upper pressure sleeve 41, under pressure from upper piston 42, has descended and engaged the material M, as shown in FIG. 3, following which further descent of the outer slide holder will bring the blank and draw punch 50 into engagement with the material M and will blank it against the cut edge 60 so as to form the starting blank from which the finished container will ultimately be produced.

Figure 4:
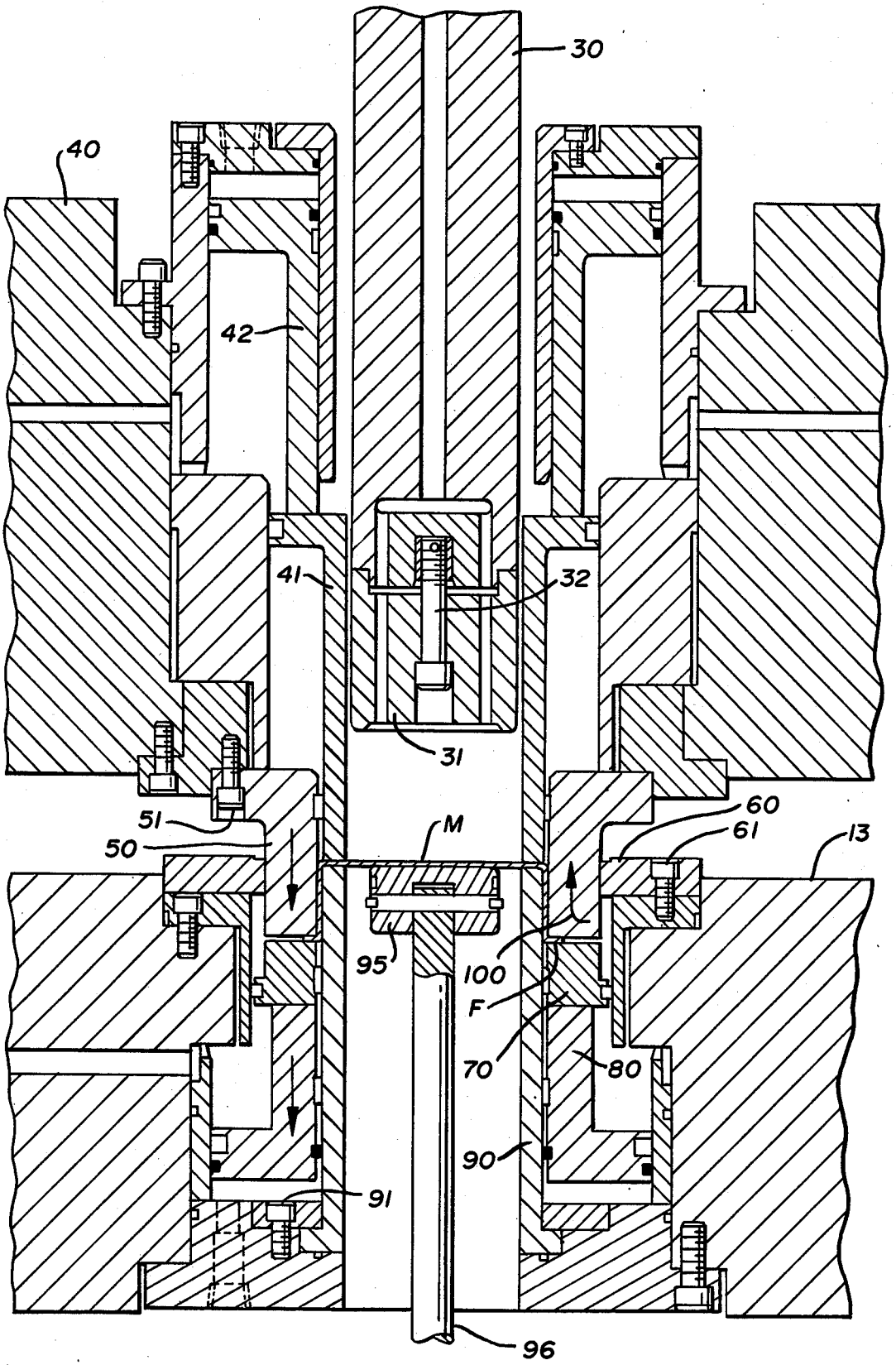
FIG. 4 is a partial elevational view, partially in section, showing the position of the tooling upon forming of the inverted cup.

With reference to FIG. 4, it will be seen that the first inverted cup is in the process of being formed from the blank just formed in FIG. 3. Thus, it will be noted that the upper pressure sleeve 41 is still in contact with the material M under pneumatic or hydraulic pressure from the upper piston 42. However, as the outer slide holder descends, the blank and draw punch 50 has wiped the material M about the top of the fixed die core ring 90 so as to preliminarily form an inverted cup from the material M. It will be noted here, also, that the blank and draw punch 50 has forced the draw pad 70 and lower piston 80 down overcoming the supporting pneumatic or hydraulic force beneath it. It will also be noted that the material has been pulled or flows in the direction of the arrow 100 from the periphery of the blank, formed in FIG. 3, so as to form the side wall of the inverted cup.

It is important to note here that pressure sleeve 41 initially contacted the material prior to blanking in FIG. 3 and will remain in contact throughout as will draw horn 90. It will also be noted that Flange F is held between blank and draw punch 50 and draw pad 70 and will be so retained throughout.

Figure 5:
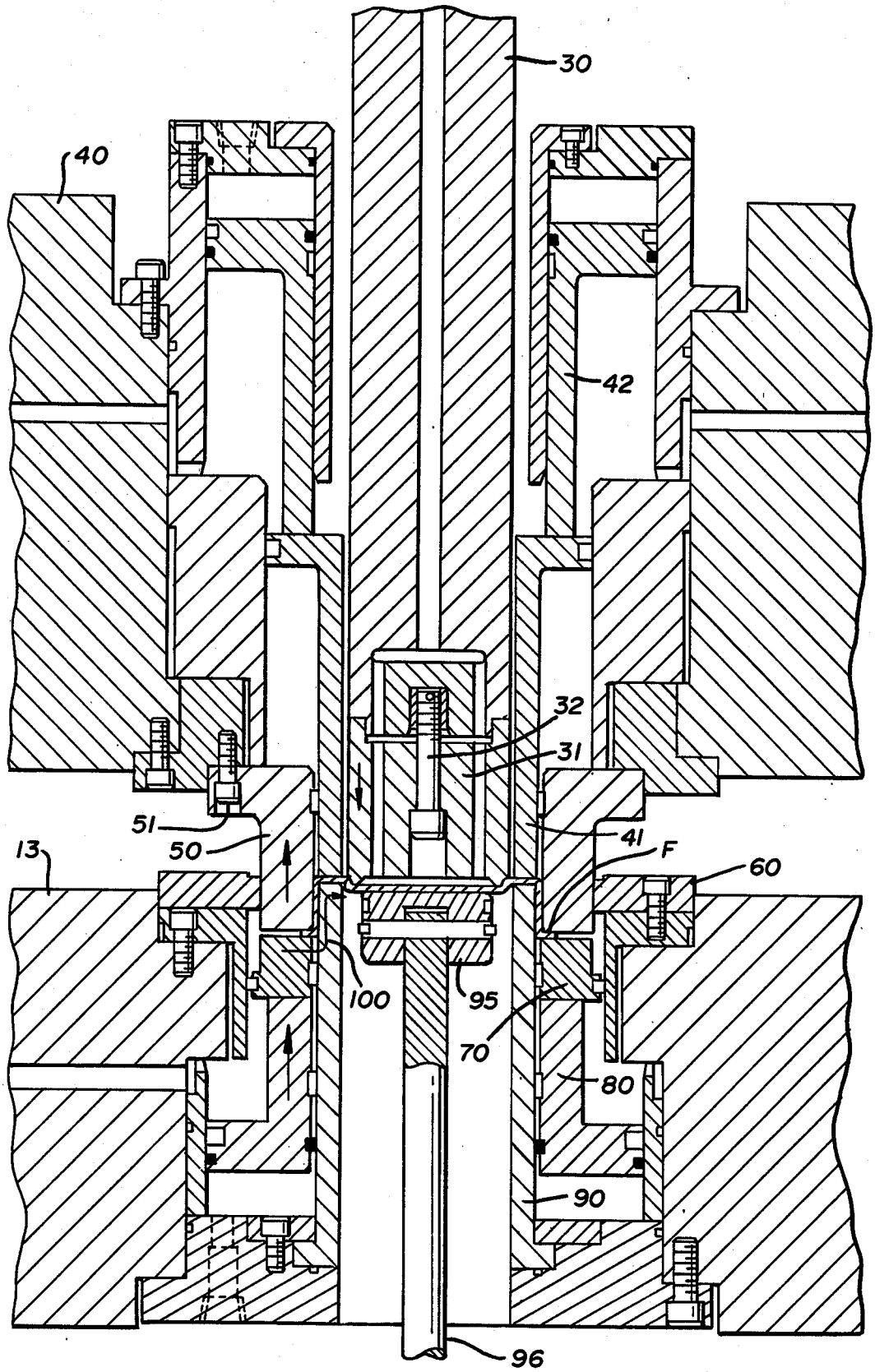
FIG. 5 is a partial elevational view, partially in section, showing the position of the tooling at the start of the reverse draw.

Turning next to FIG. 5, it will be noted that the outer slide holder has ceased movement and is beginning to withdraw away from the bed 13. The inner slide holder, however, has continued to descend and the draw horn 31 has come into contact with the top of the material M with the knockout pad 95 supporting the opposed side of the material M. This is the position of the tooling at the start of the reverse draw of the inverted flanged cup to form a reversed flanged cup.

Accordingly, it will be noted that since the outer slide and slide holder has begun to pull away, taking with it blank and draw punch 50, the lower piston 80 will begin to move up and forcing the draw pad 70 upward also, as clearly indicated by the arrows on the drawings. Flange F remains trapped between these members. Continued descent of the inner slide, moreover, brings the draw horn 31 further down toward the bed 13. This exerts force on the knockout pad 95 forcing it downwardly and, effectively, turns the inverted cup of FIGS. 4 and 5 inside out, pulling the material from the peripheral wall area thereof in the direction of the arrow 100 so as to form, effectively, a reversed flanged cup as shown in FIG. 6.

Again, pressure sleeve 41 and draw horn 90 remain in contact and flange F remains between blank and draw punch 50 and draw pad 60.

Figure 7:
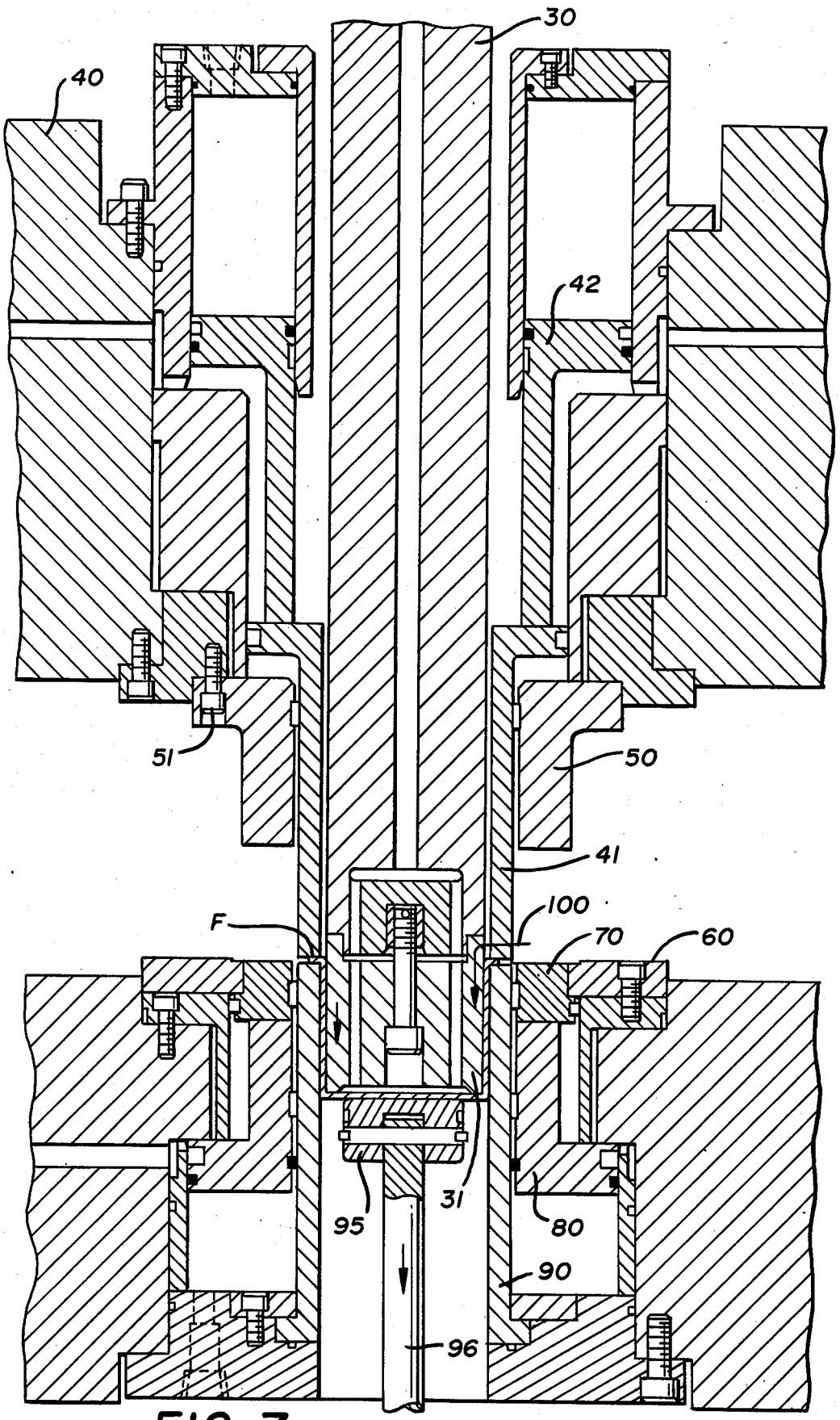
FIG. 7 is a partial elevational view, partially in section, showing the position of the tooling following formation of the inverted cup.
Figure 8:
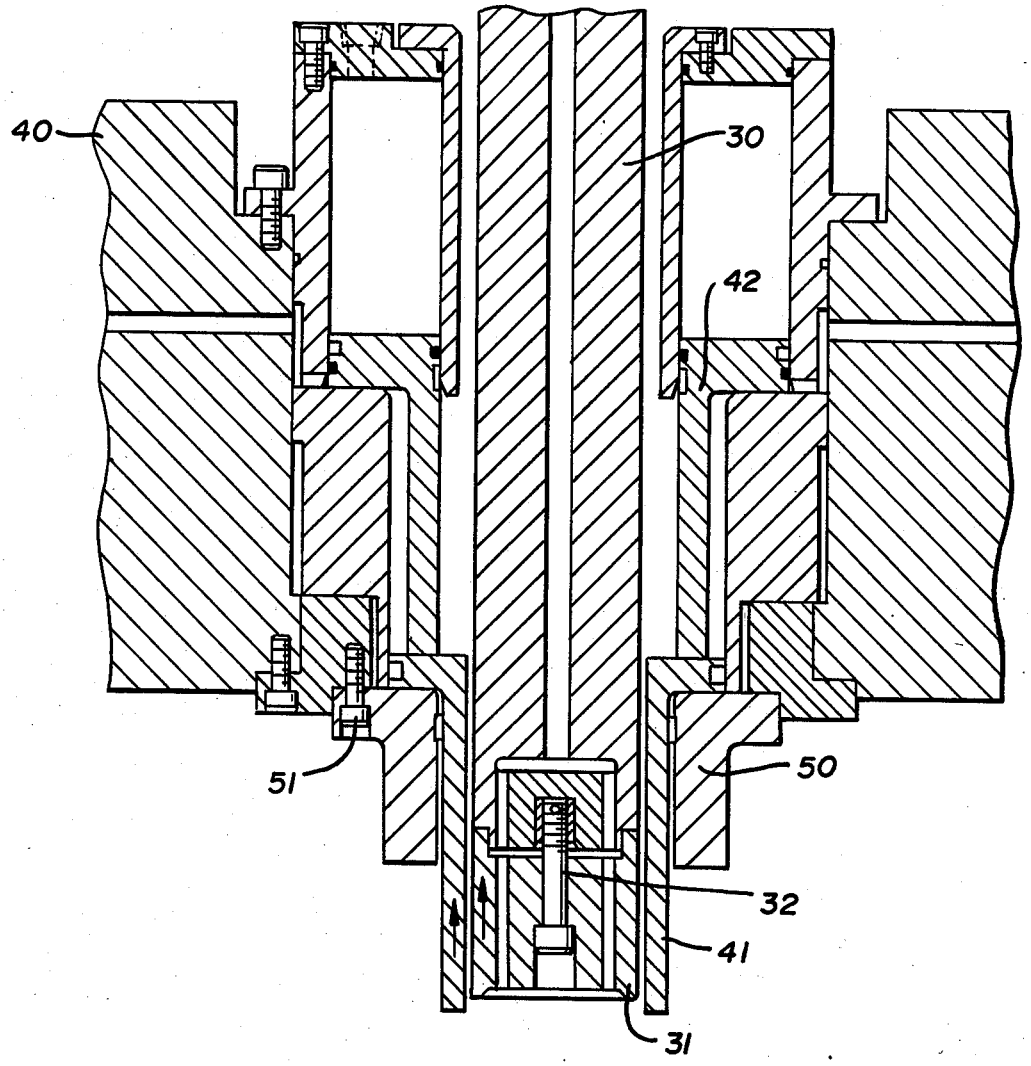
FIG. 8 is a partial elevational view, partially in section, showing the finish of the operation of the first station with the flanged cup being elevated for removal from the press.
Figure 8:
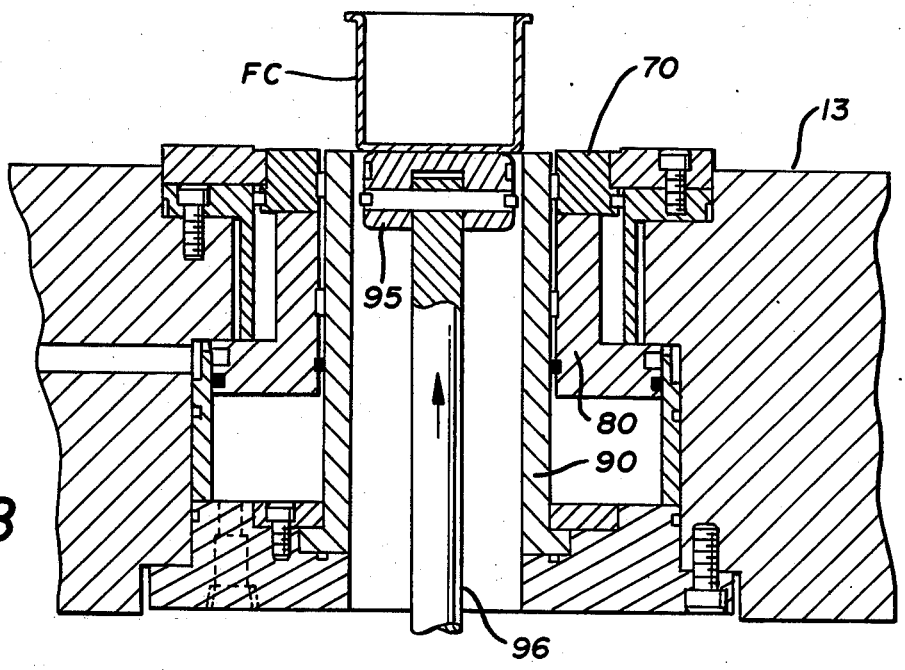

FIG. 7 is merely an illustration of the position of the tooling at the end of the formation of the reversed flanged cup wherein it will be noted that the outer slide holder has pulled completely away from bed 13 and the inner slide holder has descended to bottom dead center. At this point, the flanged cup of the first station is completed and, with reference to FIG. 8, it will be noted that the inner slide also now pulls away and the force beneath the knockout pad is able to come into play thereby elevating the flanged cup FC up to the die line for removal from the first station press.

Figure 6:
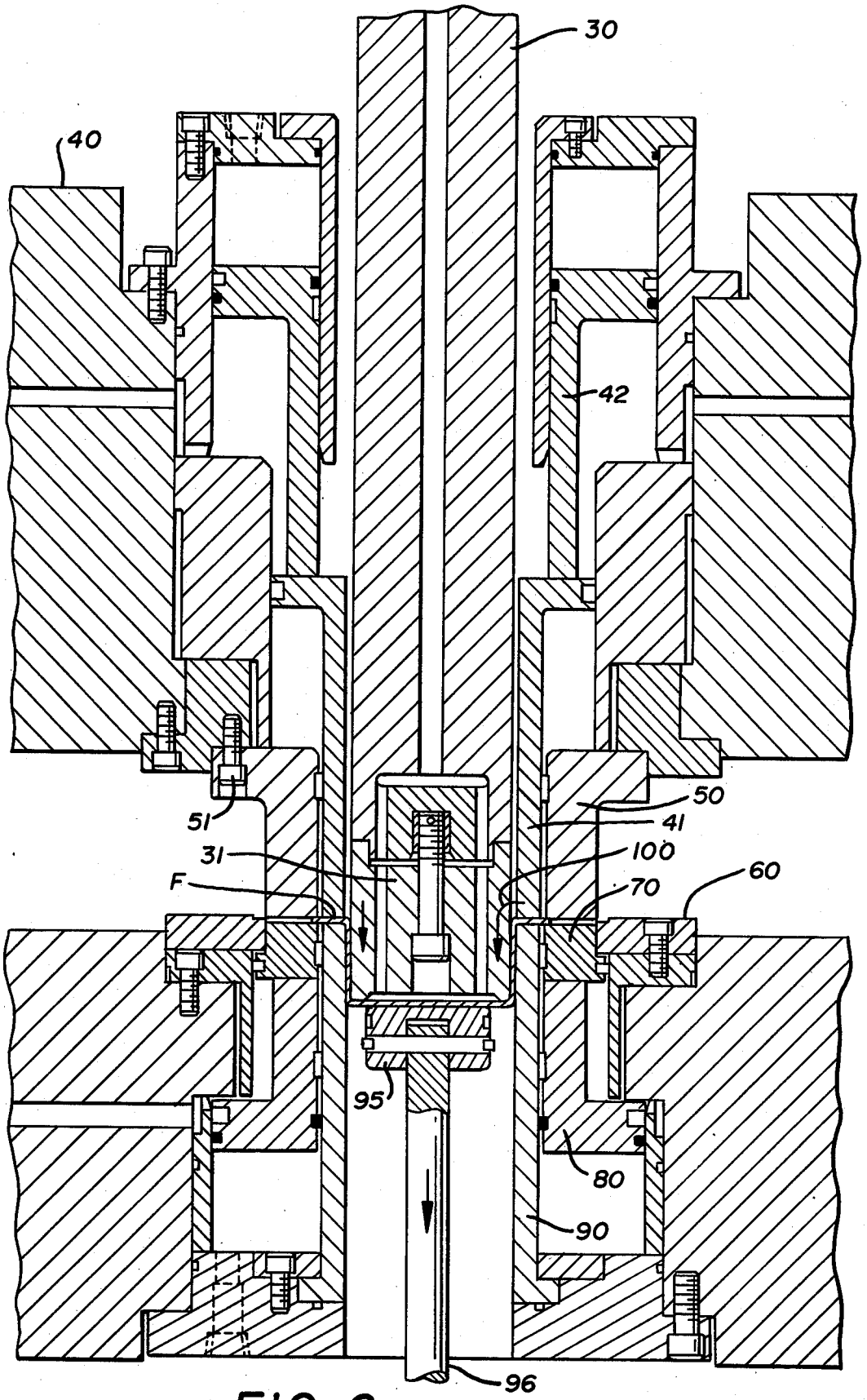
FIG. 6 is a partial elevational view, partially in section, showing the position of the tooling during the reverse draw to form the inverted cup.

It will be noted that, in the transition from the FIG. 6 position to the FIG. 7 position, blank and draw punch 50 will reach the die line as will draw pad 70. At this time, flange F is in line with the top of die core ring 90 allowing the flange to be pulled across the top of draw pad 70. Since the blank and draw punch 50 is pulling away, no pinching occurs, thereby avoid damage to the flange due to feathering.

It will then be noted from FIG. 2 that this flanged cup FC will exit the press in the direction of the arrow 22 onto the conveyor **22*a*** and follow that conveyor around for reentry into the press at the second station in order for the flanged cup FC to be converted to a completed container. Here, the previously mentioned inclination of the press permits the cup FC to simply slide onto the conveyor, eliminating the need for mechanical transfer.

Reference, then, will next be had to FIGS. 9 through 13 for the operation of the tooling at the second station. Again, only one set of tooling will be described although, as clearly shown in FIG. 2, multiple sets would be commonly used.

Figure 9:
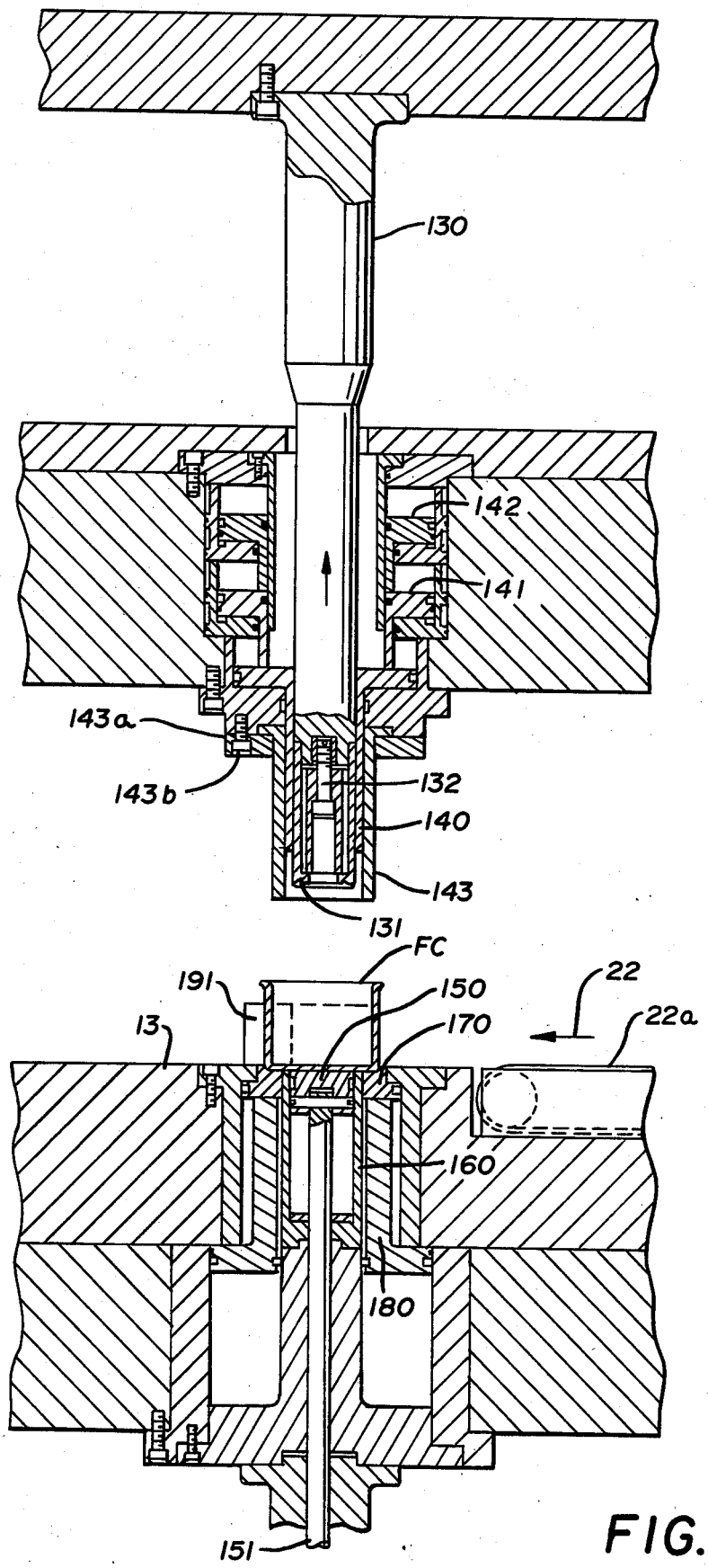
FIG. 9 is a partial elevational view, partially in section, showing the position of the tooling at the second station.

Referring, first, to FIGS. 2 and 9 of the drawings, as previously noted, the flanged cups FC will have exited the first station onto the conveyors **22*a* and will move in the direction of the arrows 22 to the second station. Referring to FIG. 2, in particular, it will be noted that the flanged cups FC will enter into the press between guide rails 190,190 and will proceed to the actual secondwork station where they will be stopped by an engagement rings 191,191. This ring is sized so that the incoming flanged cup FC will be held and will not pass through the open ends of the engagement rings 191,191. However, once the redrawing operations of the second station have been performed, the cup will be elongated into a finished container and will have a smaller diameter so that it will be able to pass on out in the direction of the arrow 23**, as will be described in greater detail below.

Referring, then, to FIG. 9 for a description of the operations performed on the flanged cup FC at the second station, the tooling involved will be first described.

Accordingly, the inner slide carries a punch holder 130 to which is secured a punch 131 by means of screw 132.

The outer slide carries a movable pressure sleeve 140 which is acted by the pneumatic or hydraulic pistons 141 and 142 which are stacked above it.

Outboard of the movable pressure sleeve 140 is a fixed pressure sleeve 143 which is secured to the outer slide holder by retainer **143*a* and one or more screws 143*b***.

The bed 13 in the second station area contains a profile pad 150 which is mounted on a knockout rod 151 which is hydraulically, pneumatically or mechanically supported on the bed 13.

Outboard of the profile pad 150 is a redraw sleeve 160 which is fixed to the bed 13. Still further outboard is a draw pad 170 and a lower piston 180 which supports and acts on the draw pad 170.

Referring to FIG. 9, it will be seen that the flanged cup FC has been introduced into the second station and has been guided into position by the guide rails 190,190 and into engagement with the rings 191,191. At this point, both the inner and outer slides of the press are in the retracted position and the profile pad 150 and draw pad 170 are in the up position.

Figure 9A:
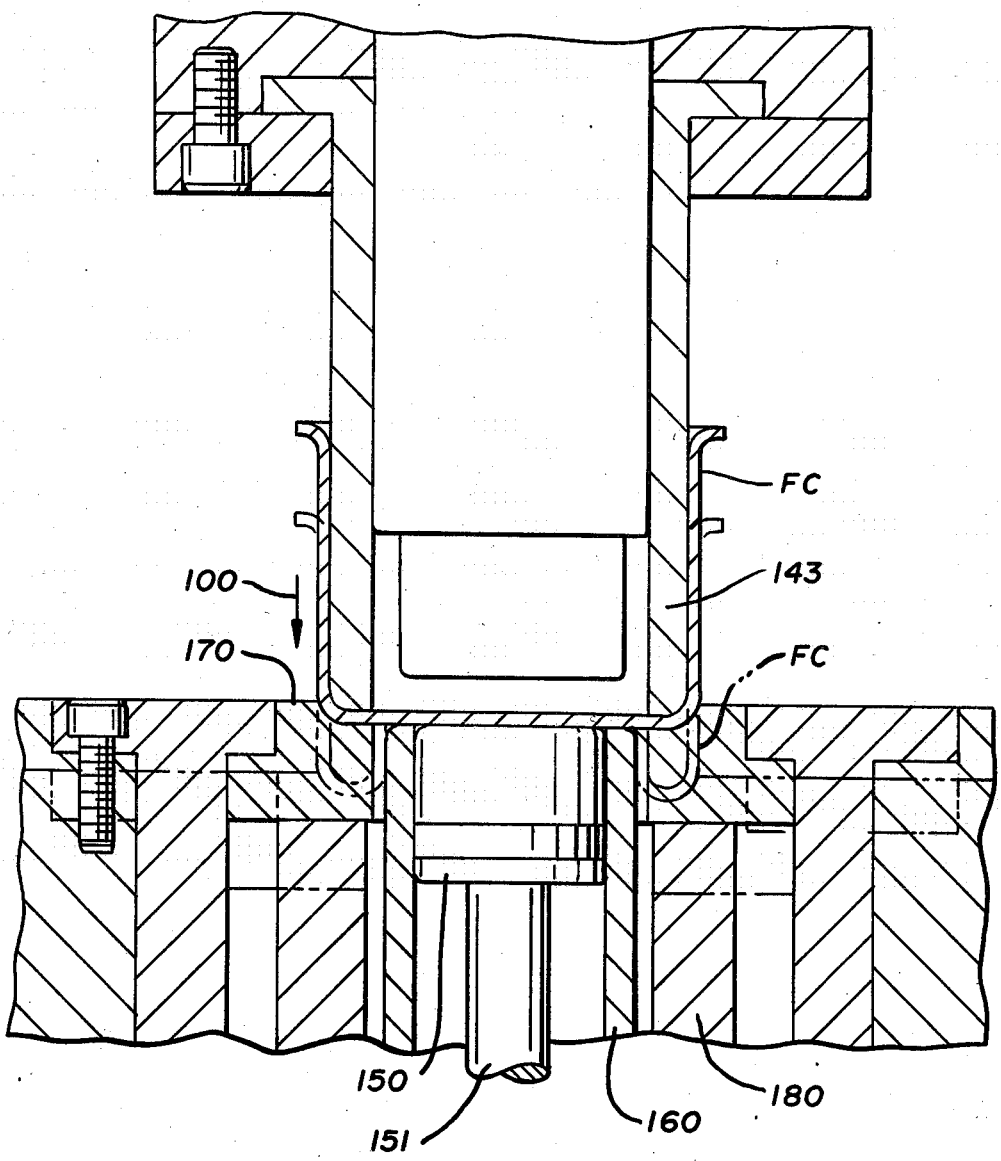
FIG. 9A is a partial elevational view, partially in section, showing the position of the tooling prior to drawing of the flanged cup into a second inverted cup.

At this time, the outer slide will be advanced toward the bed 13. This will bring the fixed pressure sleeve 143 into the interior of the cup FC and into engagement with the bottom of the cup, as can be seen more clearly in FIG. 9A which is an enlarged view. It should be noted that this engagement will be maintained throughout.

Further downward movement of the inner and outer slides, and particularly the outer slide at this point, causes fixed pressure sleeve 143 to force the cup FC into the shape of a second inverted cup. The beginning of this action can be seen by comparing the full and broken line positions of the tooling in FIG. 9A. It will then be noted that this sleeve has advanced toward the bed 13, forcing the draw pad 170 and the lower piston 180 downwardly and has pulled the material into the configuration shown in FIG. 10 of the drawings over the top of redraw sleeve 160.

Here again, it will be noted that flange F is trapped between fixed pressure sleeve 143 and draw pad 170 and will remain so throughout.

Figure 10:
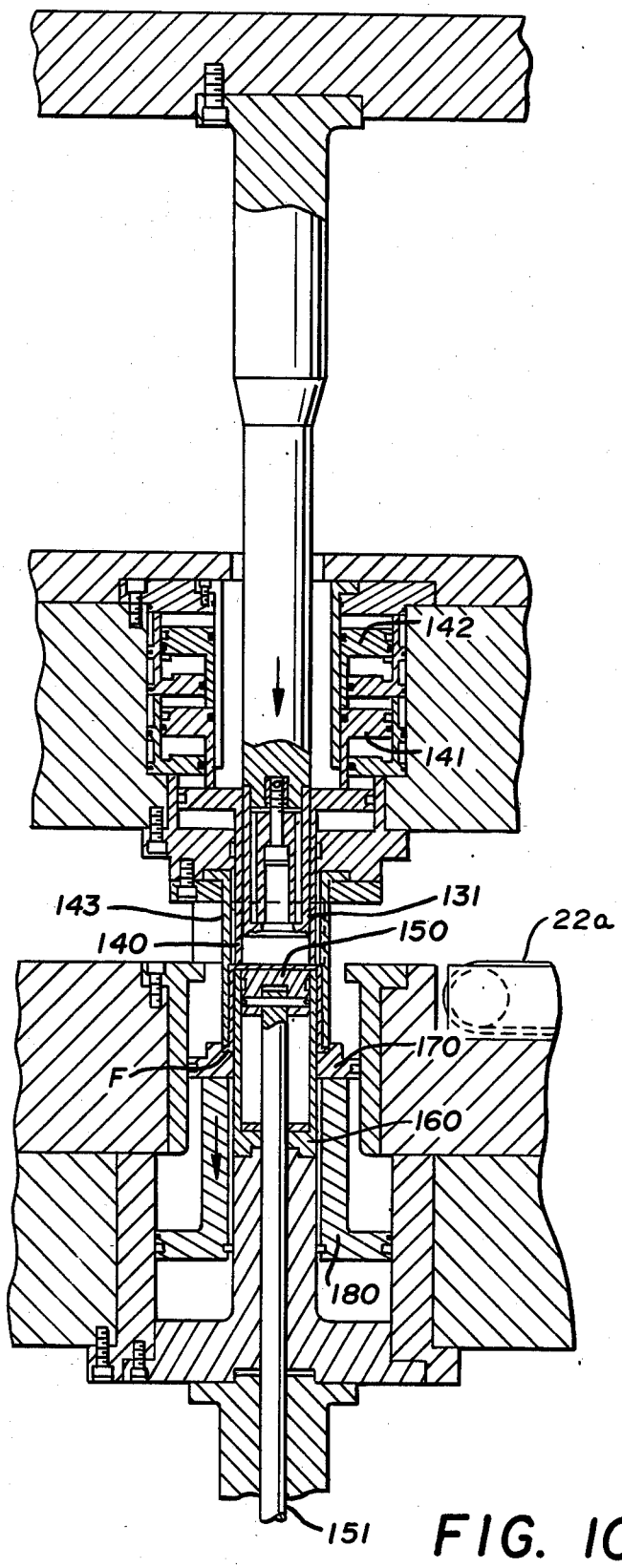
FIG. 10 is a partial elevational view, partially in section, showing the position of the tooling following forming of the flanged cup into a second inverted cup.

In the FIG. 10 position, the movable pressure sleeve 140 is also brought into engagement with the top or, more precisely, the bottom of the second inverted cup. Also at this point, the outer slide is at the bottom dead center of its movement, while the inner slide continues to move downwardly. As this occurs, the profile pad 150 is retracted and the profile punch 131 engages the bottom surface of the inverted cup and, again, turns the cup inside out, reversing and redrawing it into a flanged container while maintaining the flange F and avoiding pinching. This occurs between the positions of FIG. 10 and 11 and it will be noted that the material flows in the direction of the arrow 100 at this point, being pulled up and over the top of the redraw sleeve 160. The flange F, however, remains between fixed sleeve 143 and pad 170.

Figure 12:
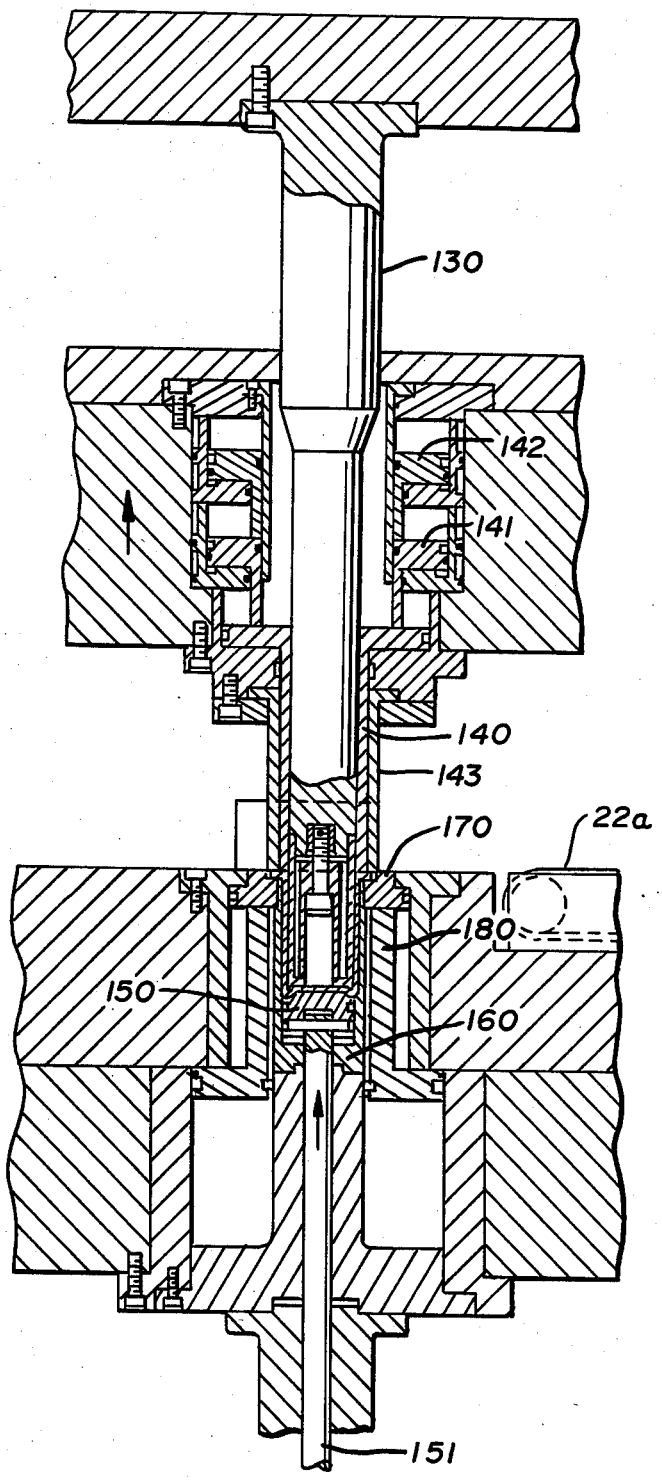
FIG. 12 is a partial elevational view, partially in section, showing the position of the tooling following reverse redrawing of the second inverted cup into a flanged container and profiling of the bottom of the container.

In FIG. 12, it will be noted that the completed flanged container CFC has been finally formed and its bottom has been profiled. This occurs by virtue of the fact that the profile pad 150 remains solid at the bottom of the stroke and as the profile punch 131 reaches its bottom range of movement, it imparts the desired profile to the bottom of the container.

Figure 11:
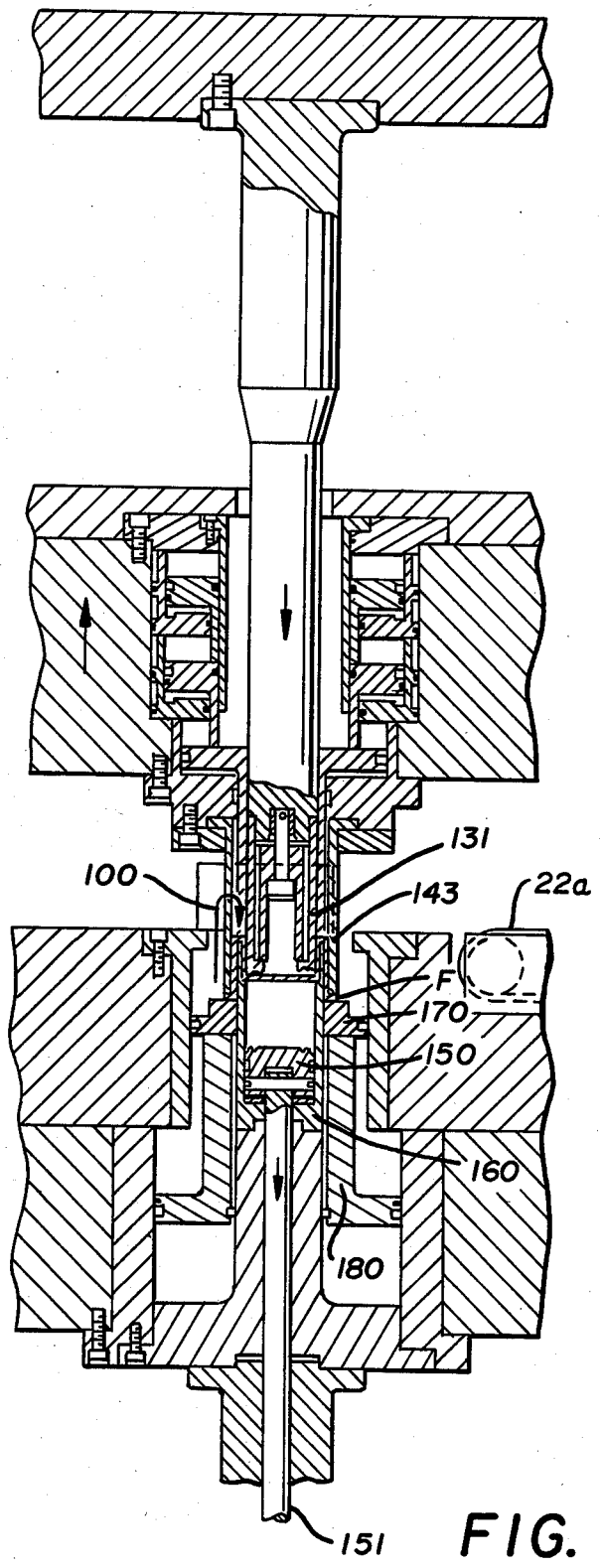
FIG. 11 is a partial elevational view, partially in section, showing the position of the tooling at the beginning of the reverse redrawing of the second inverted cup.

Keeping in mind that movable pressure sleeve 140 engages the container in FIG. 11, as the outer slide retracts, it takes fixed pressure sleeve 143 with it. Draw pad 170 follows sleeve 143 up under the force of lower piston 180 until they reach the die line. At this point, flange F is level with the top of redraw sleeve 160 and the flange F can be pulled across the top of the sleeve. Since fixed sleeve 143 is pulling away, no pinching occurs just as previously described with regard to FIG. 7.

Figure 13:
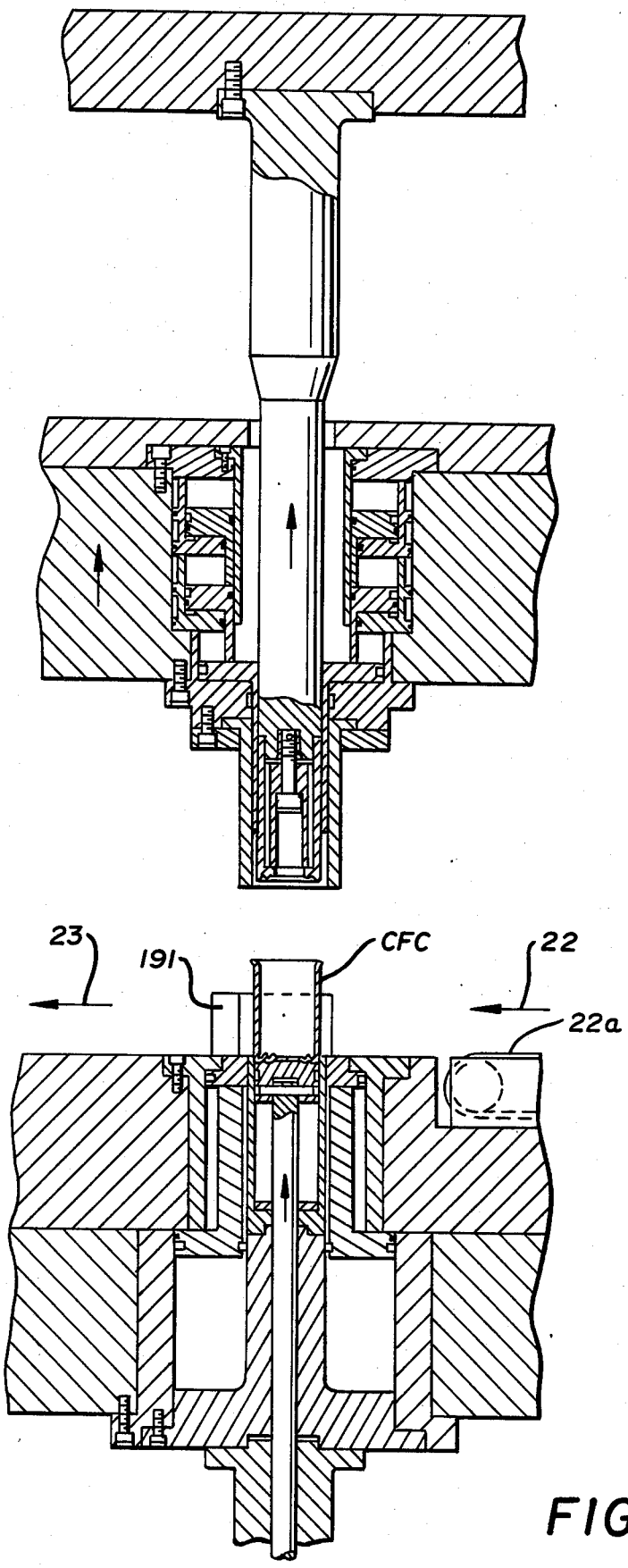
FIG. 13 is a partial elevational view, partially in section, showing the completed flanged container elevated to die line for removal from the press.

At this point, the container CFC is, essentially, finished and reference to FIG. 13 will illustrate that the inner slide has returned to its retracted position and the profile pad 150 has also been elevated to serve as a knock-out or liftout mechanism.

At this time, also, of course, as can be clearly seen by comparing FIGS. 9 and 13, the diameter of the finished container CFC is much smaller than the diameter of the flanged cup FC which entered the second station and, therefore, is of such a diameter as to make it possible to fit between the open ends of the rings 191,191 and exit the station in the direction of the arrow 23 onto the conveyor 23*a*. No mechanism is usually required for this movement, since incoming cups coming in from conveyor 22*a* in the direction of arrow 22 will simply force the finished container through the rings 191,191 and permit the next cup to be placed into position with the finished cup sliding down to the conveyor due to the inclined disposition of press 10.

In this fashion, the normal mechanical transfer has been eliminated and yet the containers are rapidly transferred in and out of the operative stations of the press. The only limitation on the operational speed of the press is the time required for the travel of a container a distance equal to its diameter.

It will also be noted that at all times during the operation of the tooling in the second station, the redraw sleeve 160 remains in place thereby climinating undue damage to the container.

Furthermore, the cup CFC has been inverted twice and redraw while retaining the flange.

It has therefore been shown that, by virtue of the repeated reverse drawing, lighter reductions are possible thereby producing a more uniform flange and avoiding earring in the flange area.

It has also been shown that, by virtue of maintaining the flange throughout, pinching and damage to the coating can be avoided.

Finally, it has been shown that by introducing the tooling, in each instance, to the container only once, damage to the coating is still further minimized.

While a full and complete description of the invention has been set forth in accordance with the dictates of the Patent Statutes, it should be understood that modifications can be resorted to without departing from the spirit hereof or the scope of the appended claims.

Thus, it will be noted that the invention has been illustrated as being employed with a single press. If desired, the tooling of the first and second stations could also be located in separate presses.

What is claimed is:

1. A method of forming a container in one or more double acting presses, comprising the steps of:

(A) at a first station, in a single stroke
  (1) forming a blank of material;
  (2) drawing an inverted flanged cup from said blank;
  (3) reverse drawing said inverted cup to form a flanged cup; and
  (4) removing said flanged cup to a second station; and (B) at said second station, in a single stroke
  (1) drawing said flanged cup into a second inverted cup;
  (2) reverse redrawing said second inverted cup into a flanged container; and
  (3) profiling the bottom of said flanged container at the bottom of the stroke.

2. The method of claim 1 wherein a flange is formed on said inverted cup; said flange being maintained through steps A(3) and A(4).

3. The method of claim 1 or 2 wherein the flange of said flanged cup is maintained through steps B(1), B(2) and B(3).

4. The method of claim 1 wherein said flanged cup is removed from said first station by gravity and transferred to said second station by conveyor.

5. The method of claim 4 wherein said flanged cup is moved into position in said second station by the force of a cup behind it on said conveyor.

6. The method of claim 1 wherein the tooling for performing step A(2) forms a flange on the cup and remains in engagement with the flange through step A(3).

7. Apparatus for forming flanged containers in one or more double acting presses from a sheet of material, comprising:

(A) at a first station (1) a blank and draw punch;

(2) a fixed hollow die core ring;

(3) said blank and draw punch being movable toward said die core ring to form an inverted cup from the material over the top of said die core ring;

(4) a draw horn movable toward said die core ring to reverse draw said inverted cup within said die core ring to form a flanged cup;

(B) at a second station (1) a hollow redraw sleeve;

(2) a first pressure sleeve movable toward said redraw sleeve to invert said flanged cup over the top of said redraw sleeve;

(3) a profile punch movable toward said redraw sleeve to reverse draw said inverted cup within said redraw sleeve.

8. The apparatus of claim 7 wherein, at said first station, a draw pad is disposed opposite said blank and draw punch; said draw pad and said blank and draw punch engaging a peripheral flange of said inverted cup.

9. The apparatus of claim 7 or 8 wherein, at said second station, a draw pad is disposed opposite said first pressure sleeve; said draw pad and said first pressure sleeve engaging a peripheral flange of said inverted flanged cup.

10. The apparatus of claim 7 wherein said blank and draw punch telescopes over said die core ring; and said draw horn telescopes within said die core ring.

11. The apparatus of claim 7 wherein said first pressure sleeve telescopes over said redraw sleeve; and said profile punch telescopes within said redraw sleeve.

12. The apparatus of claim 7 wherein said blank and draw punch telescopes over said die core ring; said draw horn telescopes within said die core ring; said first pressure sleeve telescopes over said redraw sleeve; and said profile punch telescopes within said redraw sleeve.

13. The apparatus of claim 12 wherein a piston is disposed in opposed relationship with said blank and draw punch; a peripheral edge of the material being held between said blank and draw punch and said piston as said punch telescopes over said die core ring.

14. The apparatus of claim 13 wherein said peripheral edge of the material is held between said blank and draw punch and said piston during at least a portion of the telescoping travel of said draw horn relative to said die core ring; said punch and said piston travelling in a direction opposite the direction of telescoping travel of said draw horn.

15. The apparatus of claim 12 wherein a draw pad is disposed opposite said first pressure sleeve; the flange of said cup being engaged between said first pressure sleeve and said draw pad during at least a portion of the telescoping travel of said first pressure sleeve relatively of said redraw sleeve.

16. The apparatus of claim 15 wherein the flange of said cup is held between said first pressure sleeve and said draw pad during at least a portion of the telescoping travel of said profile punch relative to said redraw sleeve; said first pressure sleeve and said draw pad travelling in a direction opposite the direction of telescoping travel of said punch.

* * * * *